United States Patent [19]

Schlesinger

[11] Patent Number: 4,772,226

[45] Date of Patent: Sep. 20, 1988

[54] SOCKET FOR A ROUND PLUG HAVING THE SAME CONTACT PATTERN

[75] Inventor: Detlev Schlesinger, Calden, Fed. Rep. of Germany

[73] Assignee: Thyssen Industrie AG, Essen, Fed. Rep. of Germany

[21] Appl. No.: 94,687

[22] Filed: Sep. 9, 1987

[30] Foreign Application Priority Data

Sep. 9, 1986 [DE] Fed. Rep. of Germany ..... 3630600

[51] Int. Cl.[4] ..... H01R 13/64

[52] U.S. Cl. ..... 439/680

[58] Field of Search ..... 439/677, 679, 680, 681

[56] References Cited

U.S. PATENT DOCUMENTS

Re. 31,462 12/1983 McCormick ..... 439/680

FOREIGN PATENT DOCUMENTS 0868017 5/1961 United Kingdom ..... 439/680

*Primary Examiner*—Neil Abrams

*Attorney, Agent, or Firm*—Becker & Becker, Inc.

[57] ABSTRACT

A socket for a round plug having the same contact pattern. The periphery of the shell of the plug, in the insertion region thereof, is provided with a guide key and several coding keys. The keys can be disposed at various angular positions relative to one another. The coupling region of the socket has a housing with an inner wall that has keyways for all of the coding keys and the guide key of the plug, with the width of each of the keyways covering the entire range of the possible positions of the guide or coding key associated with that keyway.

4 Claims, 2 Drawing Sheets

SOCKET FOR A ROUND PLUG HAVING THE SAME CONTACT PATTERN

BACKGROUND OF THE INVENTION

The present invention relates to a receptacle or socket for a round connector or plug having the same contact pattern. The periphery of the shell of the plug, in the insertion region thereof, is provided with a guide key and several (preferably four) coding keys; the keys can be disposed at various angular positions relative to one another.

The aforementioned features for preventing a false coupling, such as keys and keyways in different angular positions relative to one another, are used in order, with a given shell size and the same contact pattern of the round plug connection, to prevent polarization and hence failures or malfunctions.

To fulfill this requirement while the position of the contact insert or insulator in the socket housing remains the same, it is known to undertake either (a) a coding by five different angular positions of the main keyway while the position of the coding notches in the housing remains the same (see, for example, the Verteidigungsgerätenorm document VG 96912), or (b) a coding with six different angular positions of four coding notches while the position of the main keyway of the housing remains the same (see, for example, the Verteidigungsgerätenorm document VG 95329).

To test cables equipped with plugs of the types described in the aforementioned VG documents via cable testing devices, it is necessary to provide for each plug-coding position a socket having the pertaining coding and the electrical connections to the testing device.

For example, with round plug connections of the VG 96912 type, for nine different shell sizes and 25 contact patterns, selectively provided with sleeves or pin contacts, a total of 246 different plug sizes can be taken as possible and being involved therewith. Thus, 246 matching sockets are also necessary for cable testing.

With round plug connections of the VG 95329 type, for six different shell sizes and 12 contact patterns, selectively provided with sleeves or pin contacts, a total of 144 different plugs can be taken as possible and being involved therewith. Thus, 144 matching sockets are also required for cable testing.

However, to test cables with such plugs, the prevention of a false coupling achieved by the coding measures is not necessary, since it is necessary only to carry out electrical tests, namely contact and insulation tests, that are independent of the coding positions, whereas a visual inspection is sufficient to test the coding positions, i.e. the position of the guide and coding keys on the plugs.

It is an object of the present invention to reduce the number of sockets for carrying out cable tests (contact and insulation tests) where the cables are provided with round plugs, for example of the known prior art identified as norm series VG 96912 or VG 95329 type dated September 1982 and November 1972, respectively.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The socket of the present invention is characterized primarily in that the coupling region thereof includes a housing having an inner wall on which are provided groove means in the form of keyways for all of the coding keys and the guide key of the plug, with the width of each of these groove means covering the entire rnage of the possible positions of the guide or coding key associated with that groove means.

The primary advantage achieved with the present invention for contact and insulation testing with the aid of cable testing devices using adaptations comprising individual or several sockets joined in units in the housing, and testing cabling connected thereto and connection possibilities on the cable testing device, instead of having to have a number of coded sockets, a number of which corresponds to the number of possible coded plugs, now only a greatly reduced number of sockets with a simplified arrangement of the coding notches and keyways are necessary.

With sockets pursuant to the present invention, for the aforementioned tests of cables with plugs of the (a) known VG 96912 type, instead of 246 different sockets, only 50 different sockets are required, and (b) known VG 95329 type, instead of 144 different sockets, only 24 different sockets are required.

The inventive reduction of the number of sockets required for testing cables with testing devices, as well as the reduction in associated test cable, leads to considerable savings in cost and in space required, expense for cable systems, and a savings in weight, which is particularly advantageous for mobile use.

Further specific features of the present invention will be described in detail subsequently.

DESCRIPTION OF PREFERRED EMBODIMENTS

Figure 1:
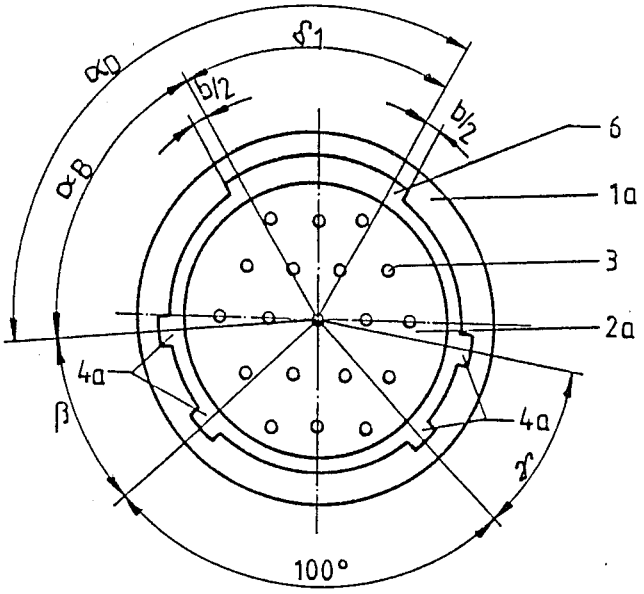
FIG. 1 is an end view of one exemplary embodiment of the present inventive socket that has a wide keyway in the region of the possible positions the main keyway in the socket housing, with this socket being suitable for plugs of the VG 96912 types.
Figure 2:
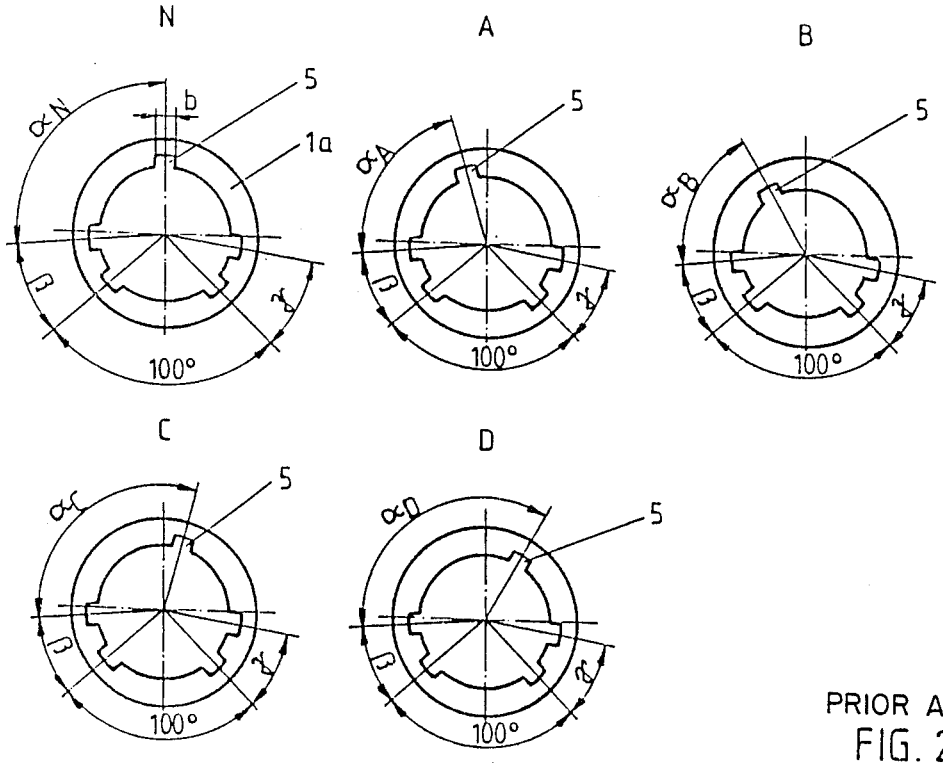
PRIOR ART FIG. 2
FIG. 2 shows the end views N, A, B, C, and D of plug positions for known VG 96912 type sockets with the possible positions of the main guide groove or key respectively keyway in the socket housing while the position of the coding notches in the housing remains the same.

Referring now to the drawings in detail, in the end view of FIG. 1, a contact insert or insulator 2*a* is secured in the socket housing 1*a;* the sleeves or pin contacts of the insert 2*a* are designated by the reference numeral 3. Four coding notches 4*a* are disposed on the lower half circle of the inner wall of the socket housing 1*a*. The angular positions of the coding notches 4*a* remain the same relative to one another and coincide with the angular positions of the coding notches in the end views N, A, B, C, and D of FIG. 2. FIGS. 1 and 2 are not drawn to the same scale.

The angles $\alpha$ and $\gamma$ are representative for the angular positions of the coding notches relative to one another; also there is noted and the angle $\alpha$, which differs in the end views N, A, B, C, and D of the socket housing 1*a* and which determines the possible positions for the main keyway 5; these angles are included in a table that is contained in the aforementioned known VG 96912 and is incorporated herein by this reference thereto.

The keyway 6 shown in the upper half circle of the socket housing 1a of FIG. 1 covers the possible positions of the main keyway 5 of FIG. 2. The angle $\gamma_1$ and the position of the keyway 6 are calculated from the tabular information for the angle $\alpha_D$ in the end view D, reduced by the angle $\alpha_B$ in the end view B, with both ends of the keyway 6 being increased by at least half of the width "b" of the main keyway 5. A plug coupled with the socket having the notch and keyway arrangement of FIG. 1 has all the sides of its coding keys guided in the notches 4*a*, and has the back surface of its guide key guided in the keyway 6.

Figure 3:
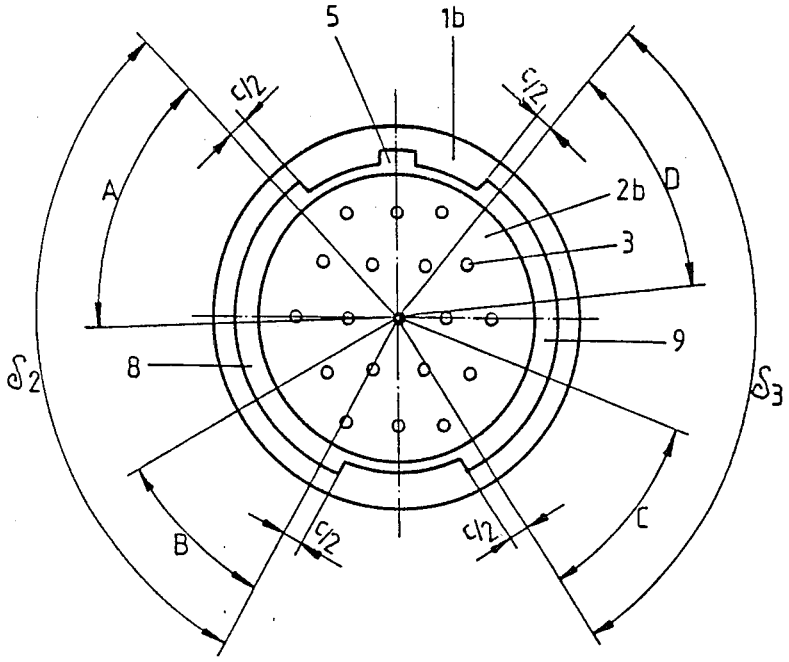
FIG. 3 is an end view of another exemplary embodiment of the present inventive socket that has wide grooves respectively keyways in the socket housing in the region of the possible positions of the coding notches, with this socket being suitable for plugs of the VG 95329 type.
Figure 4:
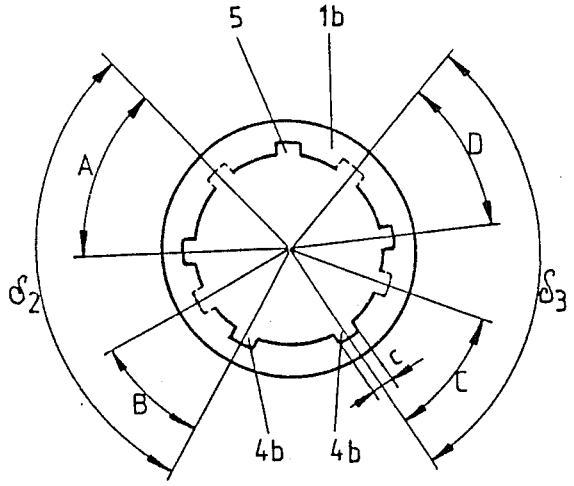
PRIOR ART FIG. 4
FIG. 4 is an end view of a plug position for a known VG 95329 type socket and indicates the sectors A, B, C, and D for the variable angular positions of four coding notches in the socket housing while the position of the main guide groove or key respectively keyway in the socket housing remains the same.

In the end view of FIG. 3, a contact insert or insulator 2*b* is secured in the socket housing 1*b;* the sleeves or pin contacts of the insert 2*b* are designated by the reference numeral 3. Shown on the upper half circle of the inner wall of the socket housing 1b is the main keyway 5, the position of which does not change for plug connections of the VG 95329 type. The wide keyways 8 and 9 cover the possible positions of the coding notches 4*b* of FIG. 4 in the sectors A+B or C+D including the sectors between the sectors A and B or C and D, with these additional sectors not having reference symbols in the drawing. The possible positions of the coding notches 4*b* in the sectors A, B, C, and D illustrated in FIG. 4 are included in a table that is contained in the aforementioned VG 95329 and that is incorporated herein by this reference thereto.

The angles $\gamma_2$ and $\delta_3$ and the positions of the keyways 8, 9 are calculated from the tabular information for the sectors A+B or C+D including the spaces therebetween, with both ends of the keyways 8, 9 being increased by at least half of the width "c" of the coding notch 4*b*.

A plug coupled with the socket having the keyway arrangement of FIG. 3 has all sides of the guide key guided in the main keyway 5, and has the back surfaces of the coding keys guided in the keyways 8, 9.

The present invention is, of course, in no way restricted to the specific disclosure of the specification and drawings, but also encompasses any modifications within the scope of the appended claims.

What I claim is:

1. A socket to reduce the number of sockets for carrying out cable tests including contact and insulation tests where the cables are provided with round plugs having the same contact pattern, whereby the periphery of the shell of the plug, in the insertion region thereof, is provided with a guide key and several coding keys; said keys can be disposed at various angular positions relative to one another; said socket comprises:

a coupling region for receiving said plug, with said coupling region including a housing having an inner wall that is provided with groove means including spaced apart keyways for receiving all of said coding keys and said guide key of said plug, with the width of at least one of said keyways covering a series of differently keyed plugs adapted for test purposes to include universally a predetermined entire range of the possible positions of the guide or coding keys respectively associated with that groove means in order to reduce considerably the number of sockets needed for test purposes.

2. A socket according to claim 1, where for a given angular positioning of said coding keys relative to one another, said guide key can have different positions, whereby said groove means includes a widened keyway for covering the entire range of possible positions of a guide key associated therewith.

3. A socket according to claim 1, where for a given position of said guide key, different positions for said coding keys are possible, whereby said groove means includes a main keyway for accommodating said guide key, and at least one wide keyway for covering the entire range of possible positions of coding keys associated therewith.

4. A socket according to claim 3, in which said groove means includes two wide keyways for said coding keys.

* * * * *